US006152866A

United States Patent [19]

Kuo

[11] Patent Number: 6,152,866

[45] Date of Patent: Nov. 28, 2000

[54] FOLDING COLLAPSIBLE EXERCISING APPARATUS

[76] Inventor: Johnson Kuo, 5F., No. 6, Lane 12, Sec. 6, Hsin I Rd., Taipei, Taiwan

[21] Appl. No.: 09/487,902

[22] Filed: Jan. 19, 2000

[51] Int. Cl.[7] ..... A63B 21/04

[52] U.S. Cl. ..... 482/142; 482/130

[58] Field of Search ..... 482/130, 142, 482/123, 129, 133, 138, 145, 137, 121, 100, 907

[56] References Cited

U.S. PATENT DOCUMENTS

| | | | |
|---|---|---|---|
| D. 378,387 | 3/1997 | Easley et al. | D21/195 |
| 5,215,511 | 6/1993 | Cheng | 482/142 |
| 5,387,171 | 2/1995 | Casey et al. | 482/130 |
| 5,441,473 | 8/1995 | Safani et al. | 482/130 |
| 5,733,232 | 3/1998 | Hsu | 482/133 |

*Primary Examiner*—Stephen P Crow
*Attorney, Agent, or Firm*—Varndell & Varndell, PLLC

[57] ABSTRACT

A folding collapsible exercising apparatus includes a front base frame having a first U-shaped support and a second U-shaped support, a rear base frame slidably inserted into one end of the front base frame and locked at the desired length by a lock pin, a footboard unit pivoted to lugs at the rear base frame by locked at the desired angle by a lock pin, a seat pivoted to the second U-shaped support and locked in position by a lock pin, a supporting bar pivoted to the second U-shaped support and locked in position by a lock pin, a back support pivoted to the first U-shaped support, two elastic members bilaterally coupled between the supporting bar and the back support, a back mattress pivoted to the back support and locked in position by a lock pin, a headrest slidably coupled to the back mattress and locked in position by a lock pin, and two elastic pull cord members bilaterally coupled to the front base frame for pulling with the hands.

2 Claims, 10 Drawing Sheets

FOLDING COLLAPSIBLE EXERCISING APPARATUS

BACKGROUND AND SUMMARY OF THE INVENTION

The present invention relates to an exercising apparatus for exercising the head, the back, the hip, the arms, and the legs, and more particularly to such an exercising apparatus that can be conveniently collapsed by hand without the use of any hand tool.

FIG. 1 shows an exercising apparatus according to the prior art. This structure of exercising apparatus comprises a base frame, a bench supported on the base frame, a headrest disposed near one end of the bench, and two leg bars bilaterally disposed at the bottom side of the bench remote from the headrest. This structure of exercising apparatus occupies much storage space when not in use. Further, this structure of exercising apparatus has no damper means to impart a resisting force to the user.

It is one object of the present invention to provide an exercising apparatus, which can be conveniently collapsed by hand without the use of any hand tool. It is another object of the present invention to provide a folding collapsible exercising apparatus, which gives a resisting force to the user when operated. It is still another object of the present invention to provide a folding collapsible exercising apparatus, which can be conveniently adjusted to fit different users. According to one aspect of the present invention, the folding collapsible exercising apparatus comprises a front base frame having a first U-shaped support and a second U-shaped support, a rear base frame slidably inserted into one end of the front base frame and locked at the desired length by a lock pin, a footboard unit pivoted to lugs at the rear base frame by locked at the desired angle by a lock pin, a seat pivoted to the second U-shaped support and locked in position by a lock pin, a supporting bar pivoted to the second U-shaped support and locked in position by a lock pin, a back support pivoted to the first U-shaped support, two elastic members bilaterally coupled between the supporting bar and the back support, a back mattress pivoted to the back support and locked in position by a lock pin, and a headrest slidably coupled to the back mattress and locked in position by a lock pin. According to another aspect of the present invention, the folding collapsible exercising apparatus can be folded up and set into a flat manner after removal of the respective lock pins. According to still another aspect of the present invention, two elastic pull cord members are bilaterally coupled to respective locating rings at a transverse bar at the front base frame for pulling with the hands.

DETAILED DESCRIPTION OF THE PREFERRED EMBODIMENT

Figure 1:
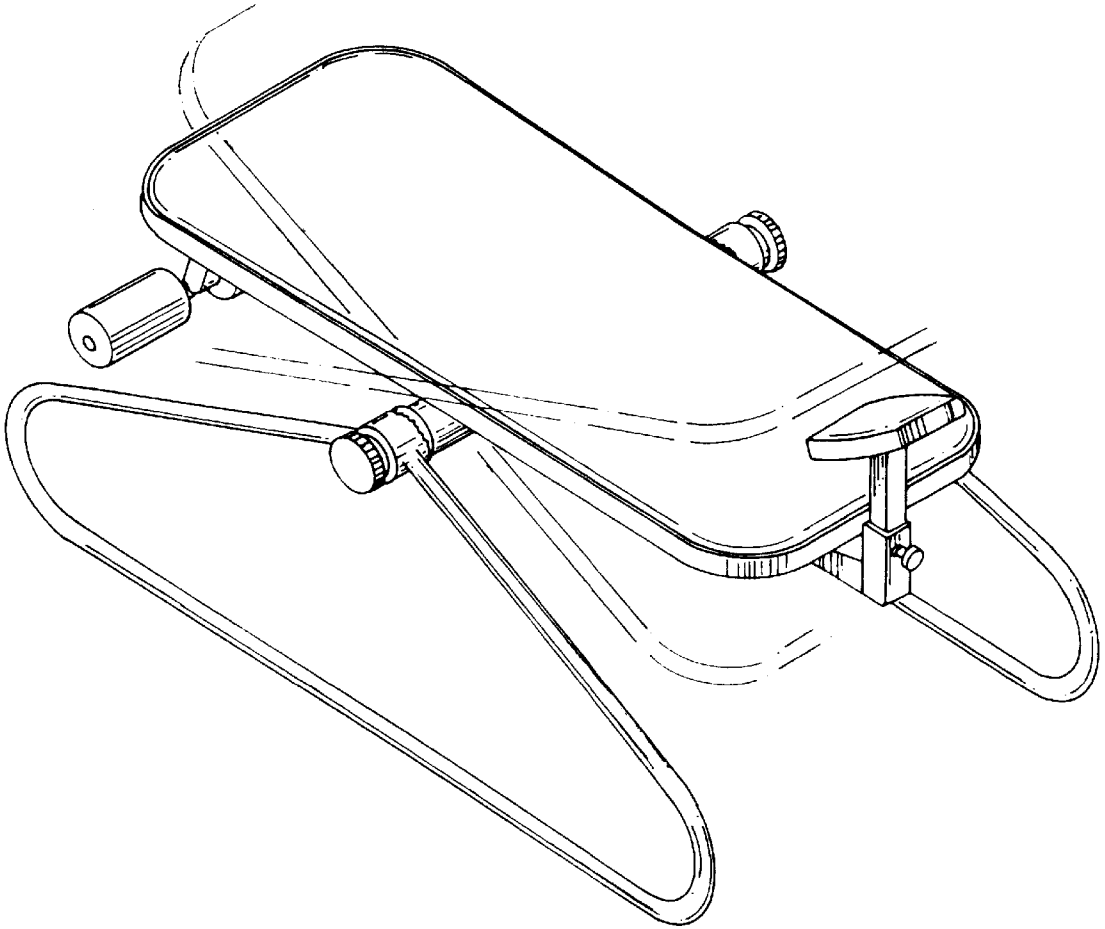
Fig. 1 PRIOR ART
FIG. 1 is an elevational view of an exercising apparatus according to the prior art.
Figure 2:
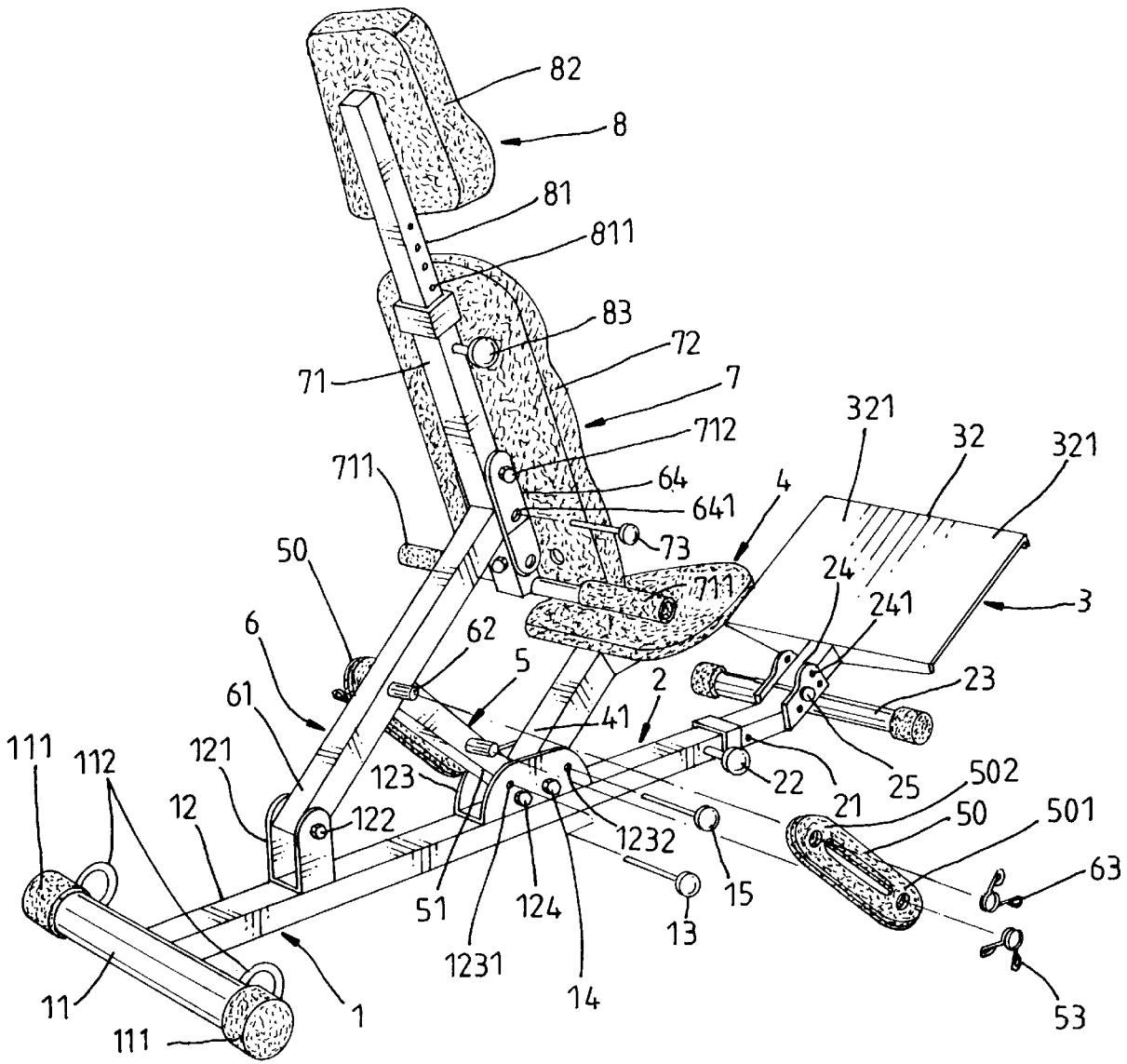
FIG. 2 is an exploded view of a folding collapsible exercising apparatus according to the present invention (the rubber pull cord members excluded).
Figure 3:
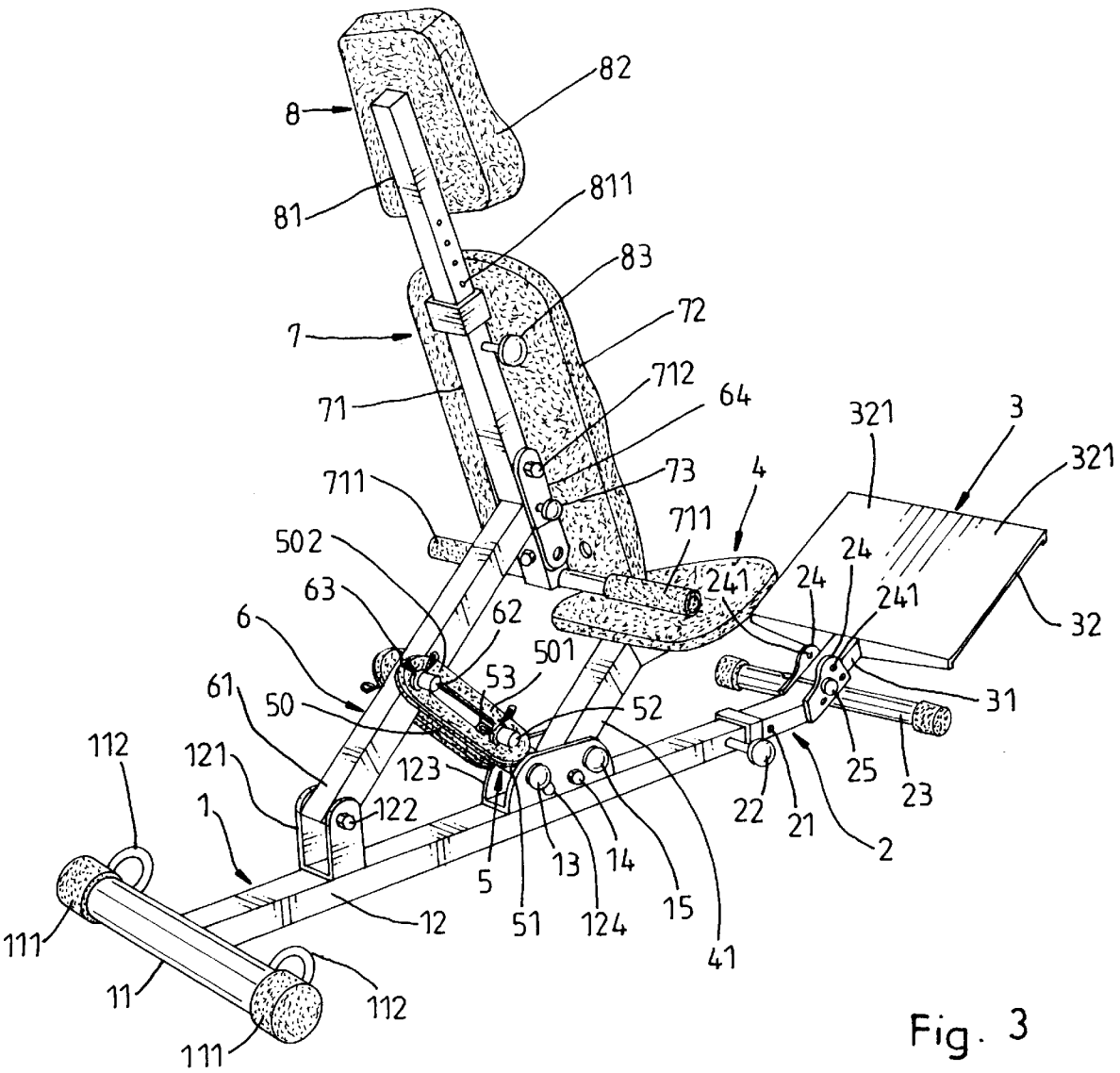
FIG. 3 is a perspective assembly view of the folding collapsible exercising apparatus according to the present invention.

Referring to Figures from 2 through 10, a folding collapsible exercising apparatus in accordance with the present invention is generally comprised of a front base frame 1, a rear base frame 2, a footboard unit 3, a seat 4, a supporting bar 5, two elastic members 50, a back support 6, a back mattress 7, and a headrest unit 8.

The front base frame 1 comprises a hollow main shaft 12 connected to the rear base frame 2, a transverse bar 11 perpendicularly connected to one end of the main shaft 12 remote from the rear base frame 2, a first U-shaped support 121 and a second U-shaped support 123 formed integral with the main shaft 12 at the top side, and two rollers 111 at two opposite ends of the transverse bar 11 for enabling the front base frame 1 to be conveniently moved on the floor. The second U-shaped support 123 comprises two first lock holes 1231 aligned on the two opposite upright sidewalls at the front side near the top, and two second lock holes 1232 aligned on the two opposite upright sidewalls at the rear side near the top. The rear base frame 2 is inserted into the main shaft 12 of the front base frame 1, comprising a longitudinal series of locating holes 21 selectively fastened to the hollow main shaft 12 by a lock pin 22, a cross bar 23 for supporting the rear base frame 2 on the floor, and two parallel lugs 24 for holding the foot board unit 3. The lugs 24 have a Plurality of locating holes 241 symmetrically disposed at different angles. The footboard unit 3 comprises a footboard 32, and a stem 31 extended from the footboard 32 at one side and pivoted to the rear base frame 2 and selectively fastened to the locating holes 241 at the desired angle by a lock pin 25. The seat 4 comprises a seat tube 41 pivoted to the second U-shaped support 123 by a pivot 14. When in use, a lock pin 15 is inserted into the two second lock holes 1232 on the second U-shaped support 123 to lock the seat 4 in position. The supporting bar 5 has a bottom end 51 pivoted to the second U-shaped support 123 by a pivot 124, a lock hole connected to the first lock holes 1231 on the U-shaped support 123 at the main shaft 12 of the front base frame 1 by a lock pin 13, and two pegs 52 respectively formed integral with two opposite lateral sidewalls thereof. The back support 6 has a bottom end 61 pivoted to the first U-shaped support 121 at the main shaft 12 of the front base frame 1 by a pivot 122, a flanged top end 64 pivoted to the back mattress 7, and two pegs 62 formed integral with two opposite sidewalls thereof on the middle. The elastic members 50 are bilaterally coupled between the back support 6 and the supporting bar 5, each having a first end 501 coupled to one ped 52 at the supporting bar 5 and a second end 502 coupled to one peg 62 at the back support 6. After installation of the elastic members 50, retainers 53 and 63 are respectively fastened to the pegs 52 at the supporting bar 5 and the pegs 62 at the back support 6 to secure the elastic members 50 in place. The back mattress 7 comprises a mattress body 72, a hollow mounting bar 71 longitudinally disposed at the back side of the mattress body 72 and pivoted to the back support 6 by a pivot 712, two handgrips 711 perpendicularly extended from the bottom end of the mounting bar 71 at two opposite sides. A lock pin 73 is inserted into a lock hole 641 on the flanged top end 64 of the back support 6 and a hole (not shown) on the mounting bar 71 to lock the back mattress 7 in position. The headrest unit 8 comprises a head rest 82, and a mounting bar 81 fixedly provided at the back side of the head rest 82 and inserted into the hollow mounting bar 71 of the back mattress 7. The mounting bar 81 of the headrest unit 8 comprises a longitudinal series of lock holes 811 selectively fastened to mounting bar 71 of the back mattress 7 by a lock pin 83.

Figure 6:
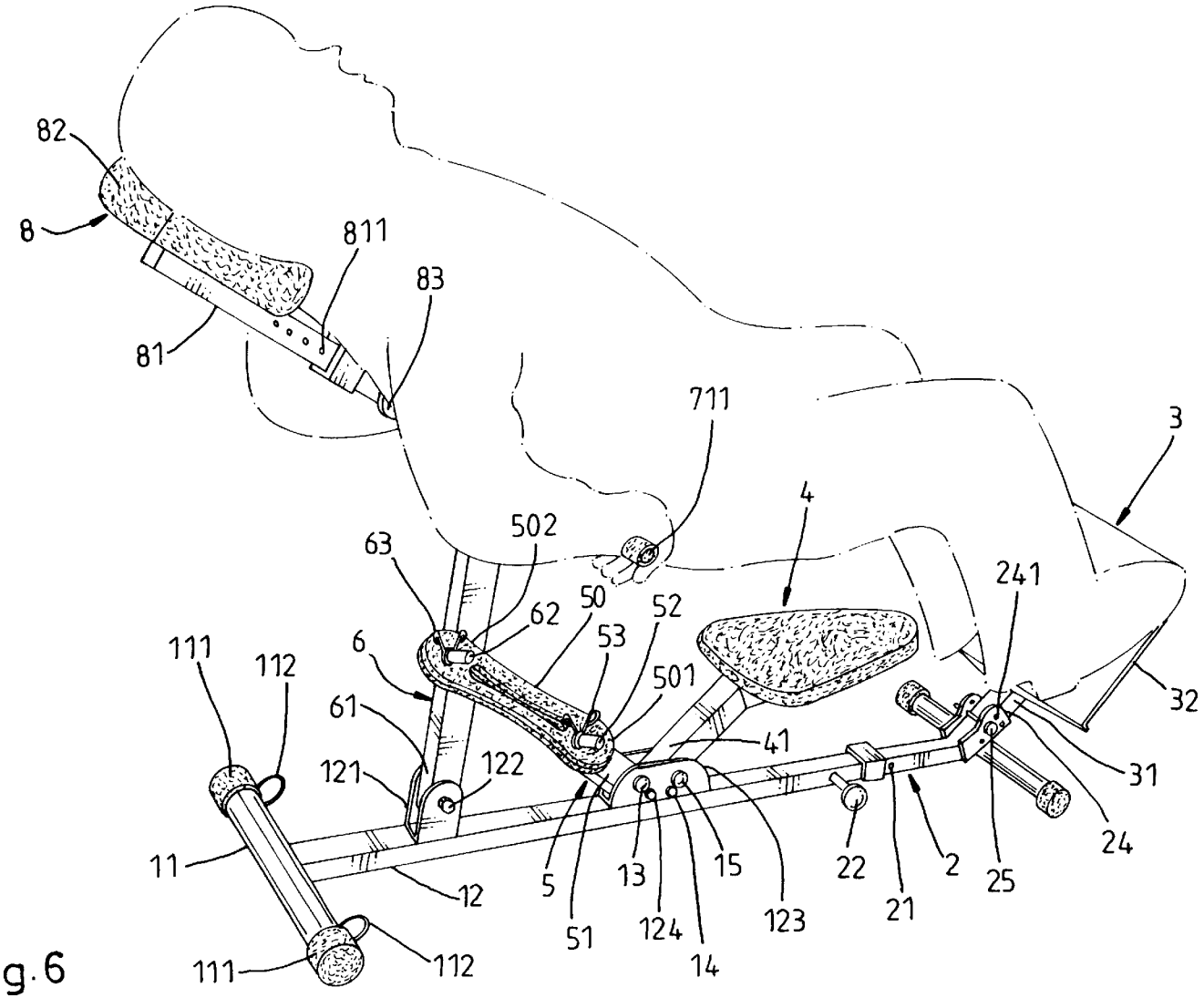
FIG. 6 shows an application example of the present invention (the rubber pull cord members not used).
Figure 7:
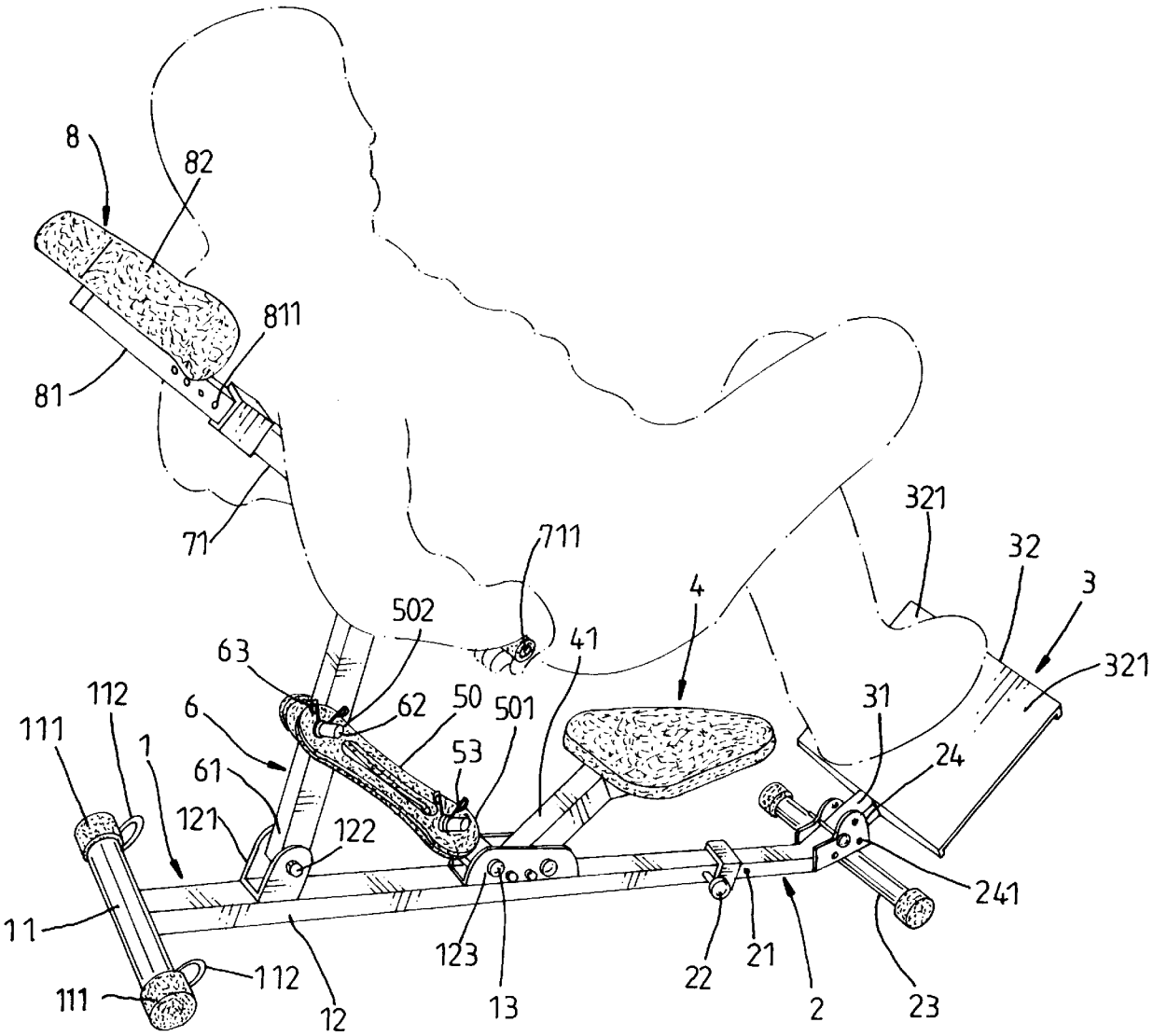
FIG. 7 shows another application example of the present invention (the rubber pull cord members not used).
Figure 8:
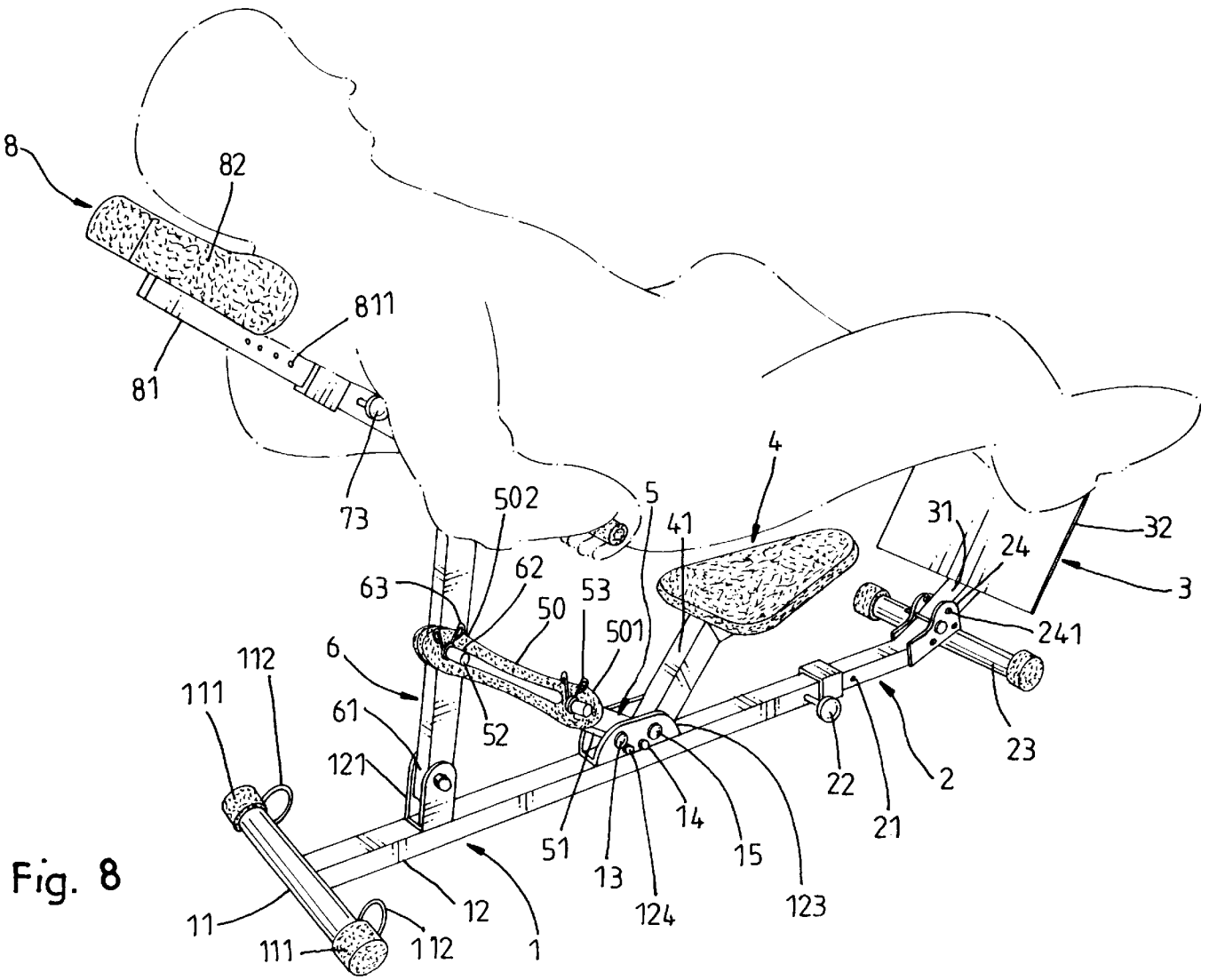
FIG. 8 shows still another application example of the present invention (the rubber pull cord members not used).

When in use, the user sits on the seat 4 with the back and the head respectively rested on the mattress body 72 of the back mattress 7 and the headrest 82 of the headrest unit 8, the feet stepped on the footboard 3, and the hands holding the handgrips 711, and the user can then push the legs, and simultaneously force the back and the head downwards to turn the back mattress 7 about the pivot 712 and the back support 6 about the pivot 122, causing the elastic members 50 to be stretched (see FIG. 6). When stretching the elastic members 50, a resisting force is given to the user (see FIG. 6), and therefeore the muscles of the back, the head, and the legs are exercises. During exercising, the user can raise one leg and push the other leg against the footboard 32 (see FIG. 7). Alternatively, the user can rest the legs on the footboard 32 with the feet stopped at the front edge 321 of the footboards 32 (see FIG. 8).

Figure 4:
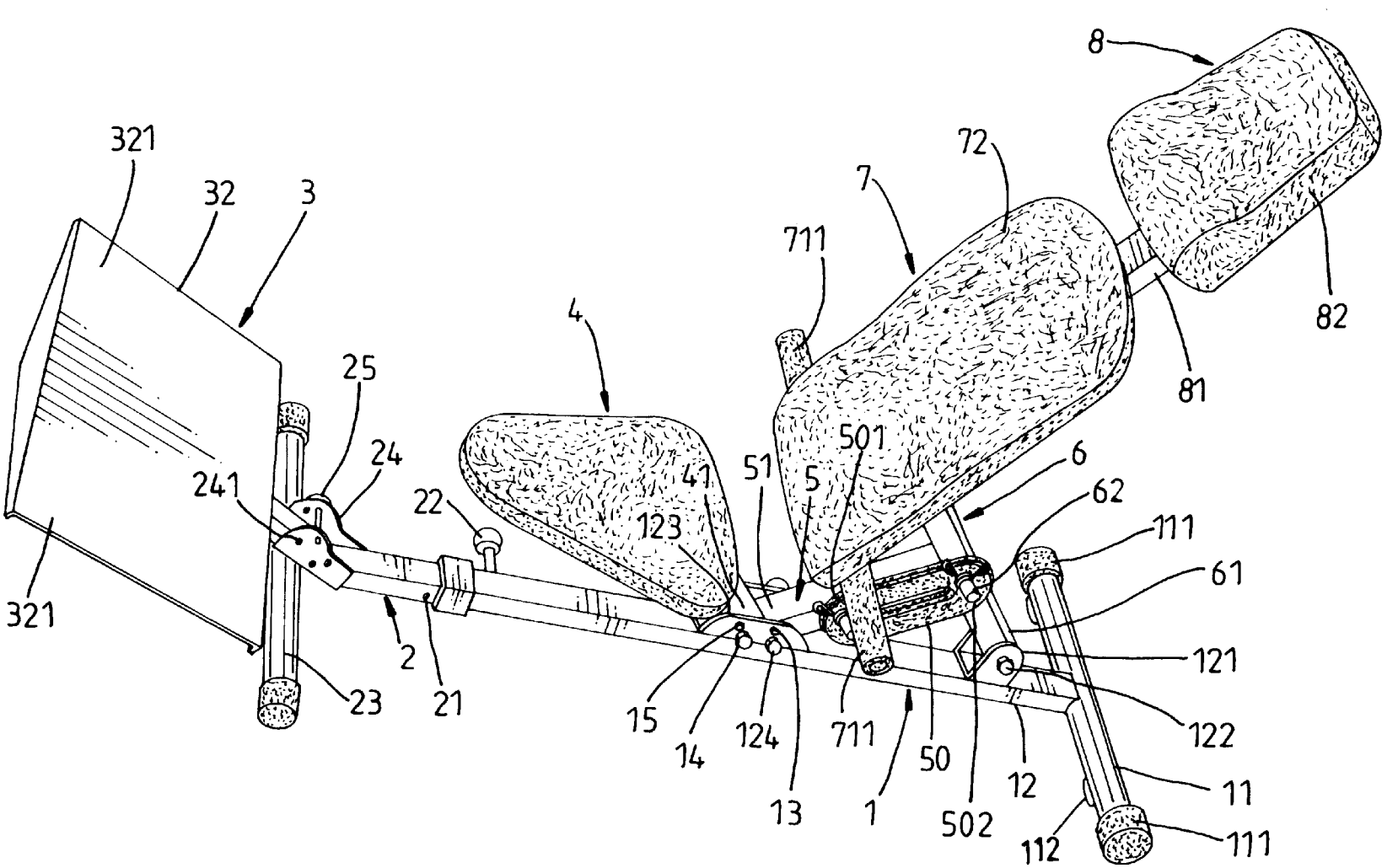
FIG. 4 is another perspective assembly view of the folding collapsible exercising apparatus according to the present invention when viewed from another angle.
Figure 5:
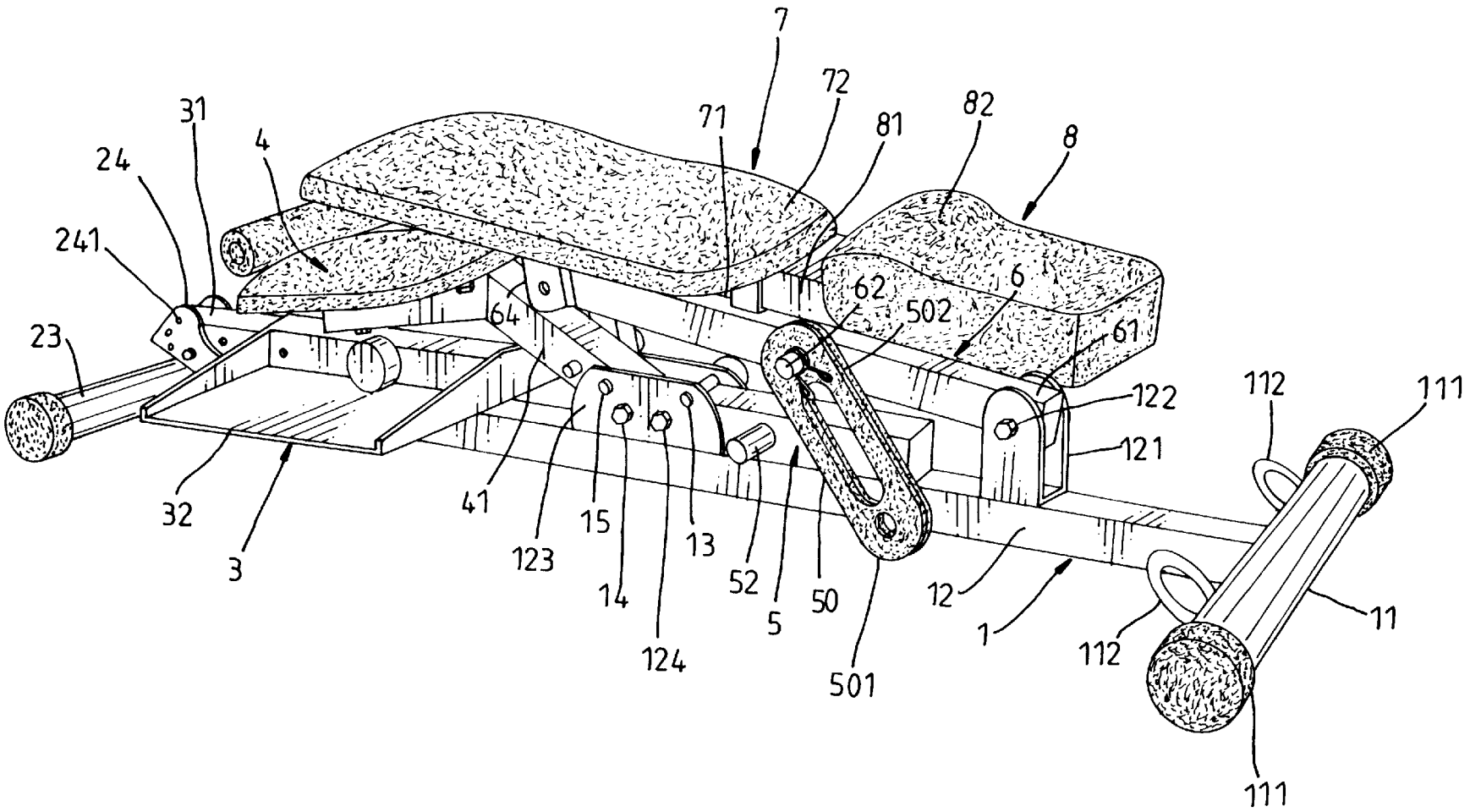
FIG. 5 shows the folding collapsible exercising apparatus collapsed according to the present invention.
Figure 9:
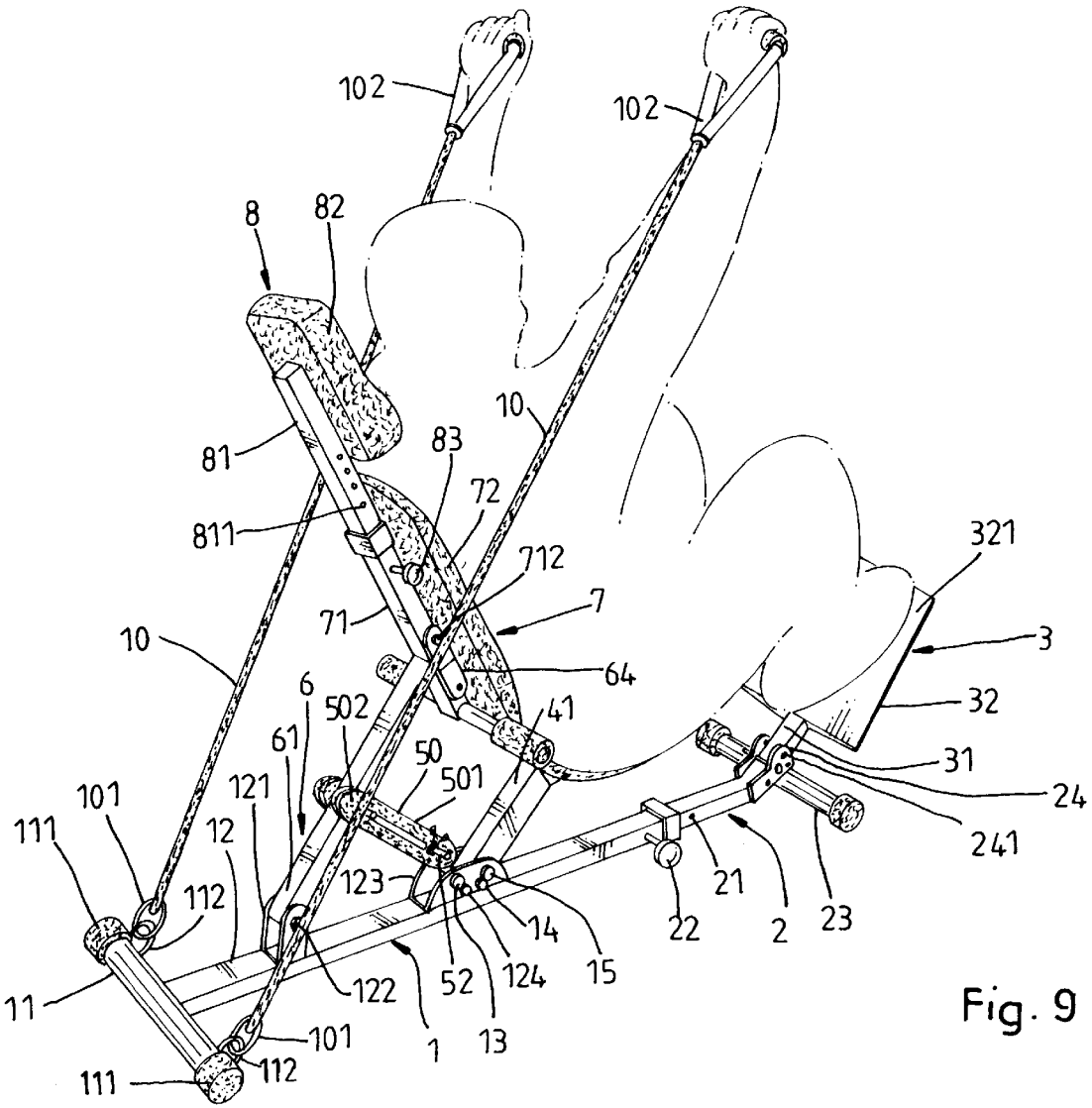
FIG. 9 shows still another application example of the present invention (the rubber pull cord members used).
Figure 10:
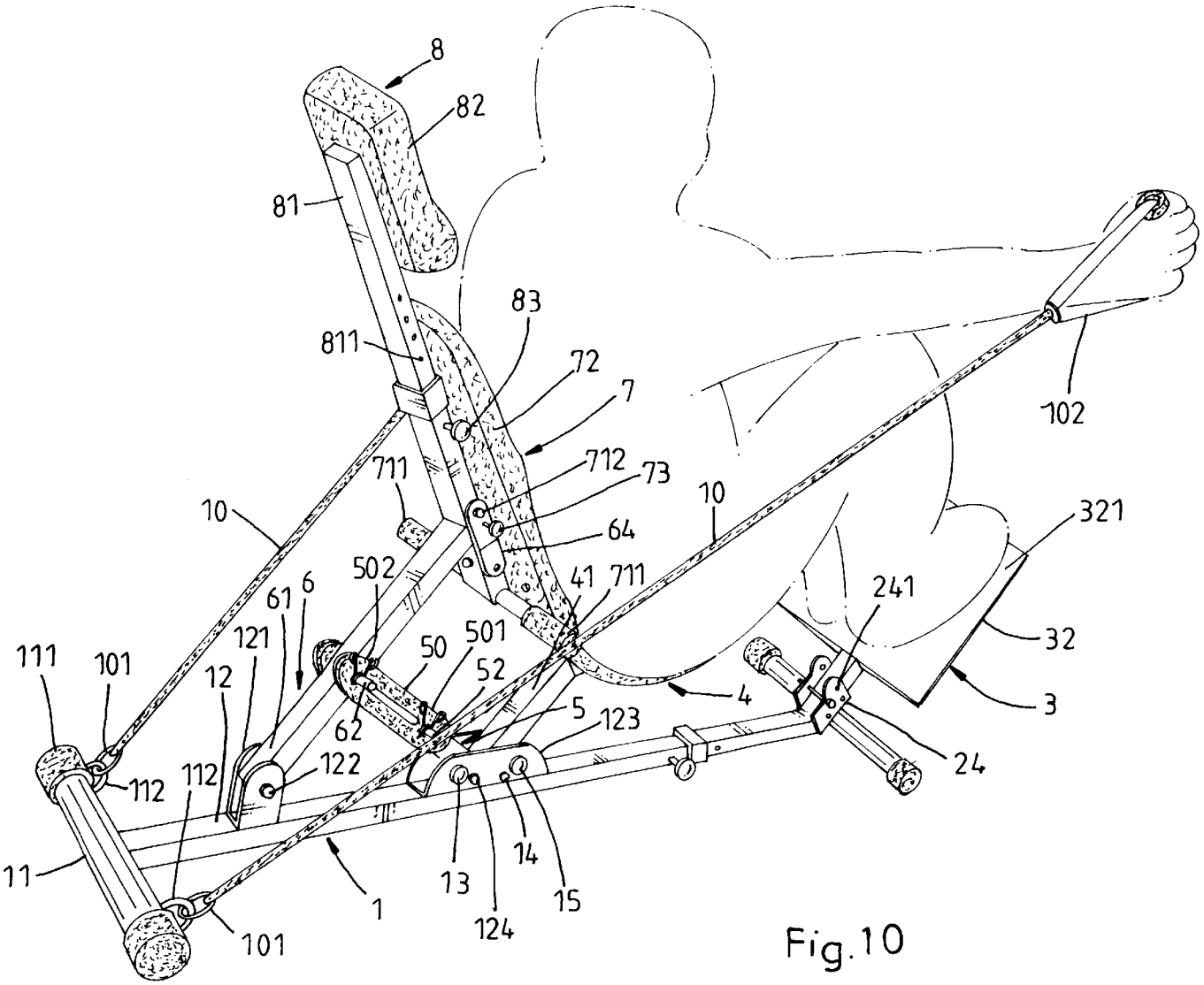
FIG. 10 shows still another application example of the present invention (the rubber pull cord members used).

Referring to FIGS. 4 and 5, when not in use, the lock pin 73 is removed from the lock hole 641 on the flanged top end 64 of the back support 6 for enabling the back mattress 7 to be turned about the pivot 712 and closely attached to the back support 6, and then the lock pins 15 and 25 are respectively removed from the front base frame 1 and the rear base frame 2, enabling the footbaord unit 3 to be turned backwards and closely attached to the main shaft 12 of the front base frame I and the seat 4 turned forwards and closely attached to the collapsed footboard unit 3, and then the lock pin 13 is removed from the front base frame 1, enabling the supporting bar 5 to be closely attached to the main shaft 12 of the front base frame 1, and then the back support 6 and the collapsed back mattress 7 are turned downwards and closely attached to the collapsed seat 4, Referring to FIGS. 9 and 10, two rubber Pull cord members 10 may be installed for pulling with the hands. The rubber pull cord members 10 each have a hook 101 at one end fastened to a respective locating ring 112 at the transverse bar 11, and an opposite end provided with a handle 102 for the holding of the hand.

What is claimed is:

1. A folding collapsible exercising apparatus comprising:

a front base frame, said front base frame comprising a hollow main shaft having a first end and a second end, a transverse bar perpendicularly connected to the first end of said main shaft, a first U-shaped support formed integral with said main shaft at a top side near said transverse bar, a second U-shaped support formed integral with said main shaft at the top side remote from said transverse bar, and two rollers at two opposite ends of said transverse bar, said second U-shaped support comprising two first lock holes and two second lock holes;

a rear base frame inserted into the second end of the main shaft of said front base frame, said rear base frame comprising a longitudinal series of locating holes selectively fastened to said hollow main shaft by a lock pin, a cross bar disposed outside said main shaft, and two parallel lugs, said parallel lugs having a plurality of locating holes symmetrically disposed at different angles;

a footboard unit coupled to said rear base frame, said footboard unit comprising a footboard, and a stem extended from said footboard at one side and pivoted to said rear base frame;

a first lock pin selectively fastened to the locating holes on the lugs of said rear base frame and a hole on the stem of said footboard unit to lock said footboard unit at the desired angle relative to said rear base frame;

a seat mounted on said main shaft of said front base frame, said seat comprising a seat tube pivoted to said second U-shaped support by a pivot;

a second lock pin inserted into the two second lock holes on the second U-shaped support and a hole on said seat tube to lock said seat in position;

a supporting bar pivoted to said second U-shaped support of said front base frame by a pivot, said supporting bar comprising a lock hole, and two pegs respectively formed integral with two opposite lateral sidewalls thereof;

a third lock pin inserted into the first lock holes on said second U-shaped support of said front base frame and the lock hole on said supporting bar to lock said supporting bar in position;

a back support pivoted to said front base frame and supported on said supporting bar, said back support comprising a bottom end pivoted to said first U-shaped support of said front base frame by a pivot, a flanged top end, and two pegs formed integral with two opposite lateral sidewalls thereof, said flanged top end comprising a lock hole;

two elastic members respectively coupled between the pegs at said supporting bar and the pegs at said back support;

a back mattress mounted on said back support, said back mattress comprising a mattress body, a hollow mounting bar longitudinally disposed at a back side of said mattress body and pivoted to said back support by a pivot, and two handgrips perpendicularly extended from the hollow mounting bar of said back mattress at two opposite sides;

a fourth lock pin inserted into the lock hole on said flanged top end of said back support and a hole on the mounting bar of said back mattress to lock said back mattress in position;

a headrest unit coupled to said back mattress, said headrest unit comprising a head rest, and a mounting bar fixedly provided at a back side of said head rest and inserted into the hollow mounting bar of said back mattress, the mounting bar of said headrest unit comprising a longitudinal series of lock holes;

a fifth lock pin inserted into a hole on the hollow mounting bar of said back mattress and one of the longitudinal series of lock holes on the mounting bar of said headrest to lock said headrest.

2. The folding collapsible exercising apparatus of claim 1 further comprising two elastic pull cord members respectively fastened to the transverse bar of said front base frame for pulling with the hands, said elastic pull cord members each having hook at one end fastened to a respective locating ring at the transverse bar of said front base frame and a handle at an ooopsite end.

* * * * *